US007640854B2

(12) United States Patent
Kott et al.

(10) Patent No.: US 7,640,854 B2
(45) Date of Patent: Jan. 5, 2010

(54) TIMING ASSEMBLY FOR A MANUFACTURED WOOD PRODUCTS PRESS

(75) Inventors: Norbert Kott, Ft. Langley (CA); Steven Rempel, Langley (CA); Orlando C. Janzen, Port Coquitlam (CA); Ayodele Adeleye, Langley (CA); Edmond Tam, Burnaby (CA); James Cheng, Langley British Columbia (CA)

(73) Assignee: Weyerhaeuser NR Company, Federal Way, WA (US)

( * ) Notice: Subject to any disclaimer, the term of this patent is extended or adjusted under 35 U.S.C. 154(b) by 756 days.

(21) Appl. No.: 11/237,560

(22) Filed: Sep. 28, 2005

(65) Prior Publication Data

US 2007/0068398 A1 Mar. 29, 2007

(51) Int. Cl.
*B30B 1/00* (2006.01)

(52) U.S. Cl. ..... 100/178; 100/193; 100/282; 156/580

(58) Field of Classification Search ..... 100/151, 100/178, 193, 280–282, 306, 315, 316; 156/580, 156/583.1

See application file for complete search history.

(56) References Cited

U.S. PATENT DOCUMENTS 2,107,607 A 2/1938 Gobel
3,608,478 A 9/1971 Hoffman
3,779,155 A * 12/1973 Ohno ..... 100/207
3,850,213 A 11/1974 Keaton
4,335,780 A 6/1982 Burkhard
4,607,732 A * 8/1986 Ikeoka et al. ..... 192/12 R
5,372,062 A 12/1994 Jonkka et al.
5,427,723 A 6/1995 Kugler et al.
6,477,945 B1 11/2002 Imanishi et al.
6,989,116 B2 1/2006 Kott
7,354,543 B2 * 4/2008 Kott et al. ..... 264/171.25
7,451,646 B2 11/2008 Weyerhaeuser
7,451,696 B2 * 11/2008 Kott et al. ..... 100/233

FOREIGN PATENT DOCUMENTS

CN 87201499 U 9/1988
WO WO 92/15447 9/1992

* cited by examiner

*Primary Examiner*—Shelley Self
(74) *Attorney, Agent, or Firm*—Rachael Vaughn

(57) ABSTRACT

A timing assembly (200) for a manufactured wood products press (66) is provided. The manufactured wood products press includes a first drive shaft (120) coupled to a first platen (90) and second drive shaft (120) coupled to a second platen (90). The first and second platens are disposed within the manufactured wood products press in an opposed manner. The timing assembly includes a housing (202) and a plurality of timing gears (204) disposed within the housing. The plurality of timing gears are operatively connected to the first and second drive shafts for simultaneously driving the first and second drive shafts in an eccentric path.

20 Claims, 10 Drawing Sheets

TIMING ASSEMBLY FOR A MANUFACTURED WOOD PRODUCTS PRESS

FIELD OF THE INVENTION

The described embodiments relate generally to engineered wood products and, more specifically, to a timing assembly for a press unit of a manufactured wood products press.

BACKGROUND OF THE INVENTION

Orientated strand board ("OSB"), parallel strand board lumber and other engineered wood products are formed by layering strands (flakes) of wood in specific orientations. Such manufactured wood products are typically manufactured in wide mats from cross-orientated layers of thin, rectangular wooden strips compressed and bonded together with wax and resin adhesives (95% wood, 5% wax and resin). These strips are created by refining wood into strips, which are sifted and then orientated on a belt.

The mat is made in forming a bed, the layers are built up with external layers aligned in the panel direction and internal layers randomly positioned. The number of layers placed is set by the required thickness of the finished panel. The mat is then placed in a thermal press system.

Recently developed press systems utilize a plurality of press units, each having opposed platens. The opposed platens are driven, in part, by an eccentric shaft and motion of the multiple platens is coordinated to permit the press system to operate as designed. Specifically, it is desirable that rotation of all of the eccentric shafts be synchronized such that all eccentric shafts rotate at substantially the same angular velocity and are in positional phase.

Thus, there exists a need for a timing assembly for a press unit of a manufactured wood product press.

SUMMARY OF THE INVENTION

A timing assembly for a manufactured wood products press is provided. Such a manufactured wood products press includes a first drive shaft coupled to a first platen and a second drive shaft coupled to a second platen. The first and second platens are disposed within the manufactured wood products press in an opposed manner. The timing assembly includes a housing and a plurality of timing gears disposed within the housing. The plurality of timing gears are connected to the first and second drive shafts for simultaneously driving the first and second drive shafts in an eccentric path.

A combination timing assembly and link assembly for a manufactured wood products press is also provided. The manufactured wood product press includes a first drive shaft coupled to a first platen and a second drive shaft coupled to a second platen. The first and second platens are disposed within the manufactured wood products press in an opposed manner. The combination timing assembly and linking assembly includes a main gear assembly and a linking gear assembly.

The main gear assembly includes a housing, a plurality of timing gears disposed within the housing, and a first drive mechanism. The first drive mechanism extends between the plurality of timing gears and one of either the first or second drive shafts to transmit motion between the main gear assembly and the first or second platen to drive the first or second platen in a non-linear motion.

The linking gear assembly includes a housing, a plurality of linking gears disposed within the housing, and a linking drive shaft. The linking drive shaft extends between one of the plurality of timing gears and one of the plurality of linking gears.

Another embodiment of a combination timing assembly and linking assembly for a manufactured wood products press is also provided. The manufactured wood product press includes a first pair of opposed platens and a second pair of opposed platens. The first pair of opposed platens includes a first plurality of drive shafts and the second pair of opposed platens includes a second plurality of drive shafts.

The combination timing assembly and linking assembly includes a first main gear assembly having a plurality of gears operatively connected to the first plurality of drive shafts. The combination timing assembly and linking assembly further includes a second main gear assembly having a plurality of gears operatively connected to the second plurality of drive shafts, and a linking gear assembly. The linking gear assembly is coupled to the first and second main gear assemblies to simultaneously drive, at least in part, the first and second pairs of opposed platens in a non-linear motion.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
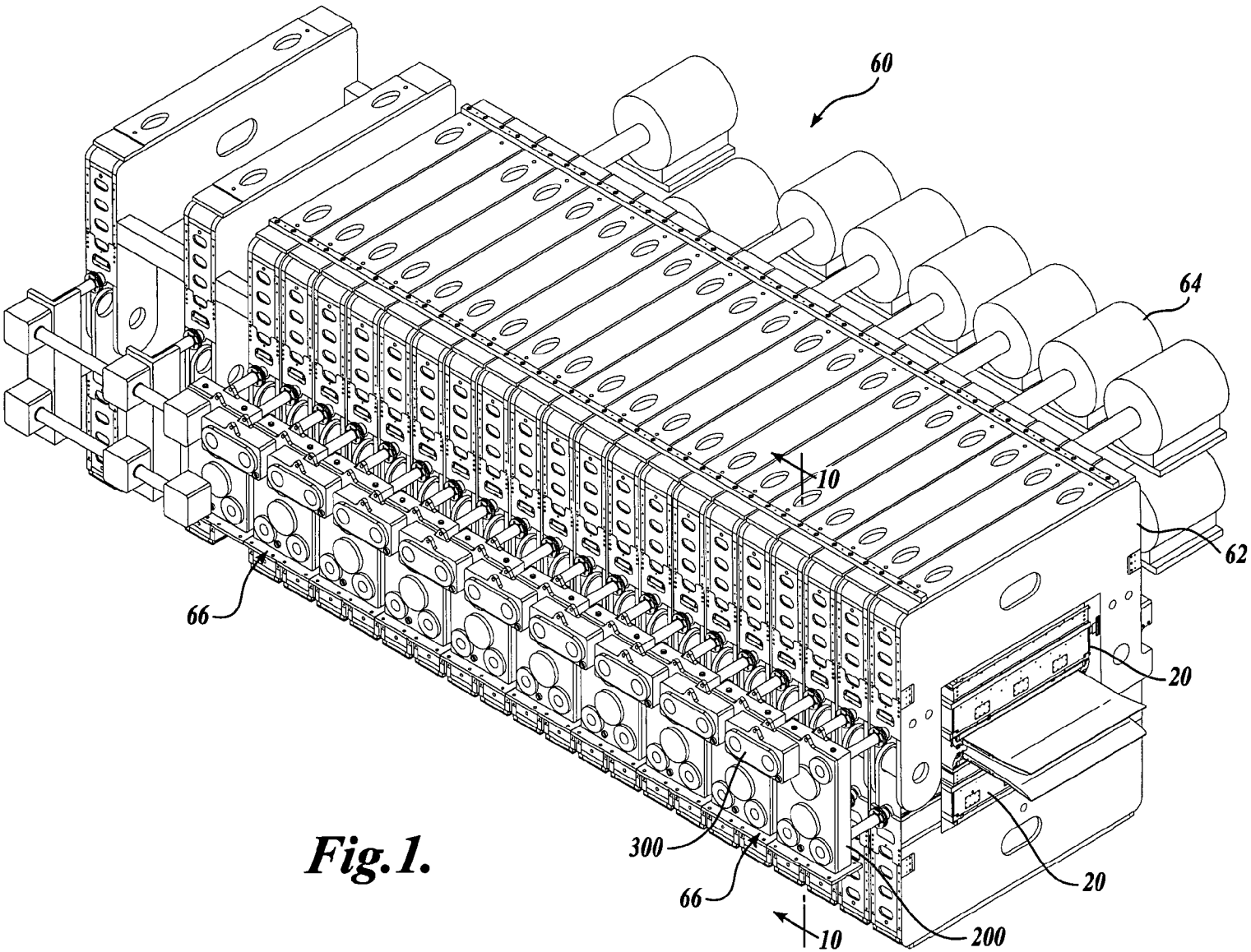
FIG. 1 is an isometric view of manufactured wood product press having a timing assembly and a linking assembly constructed in accordance with one embodiment of the present disclosure.
Figure 2:
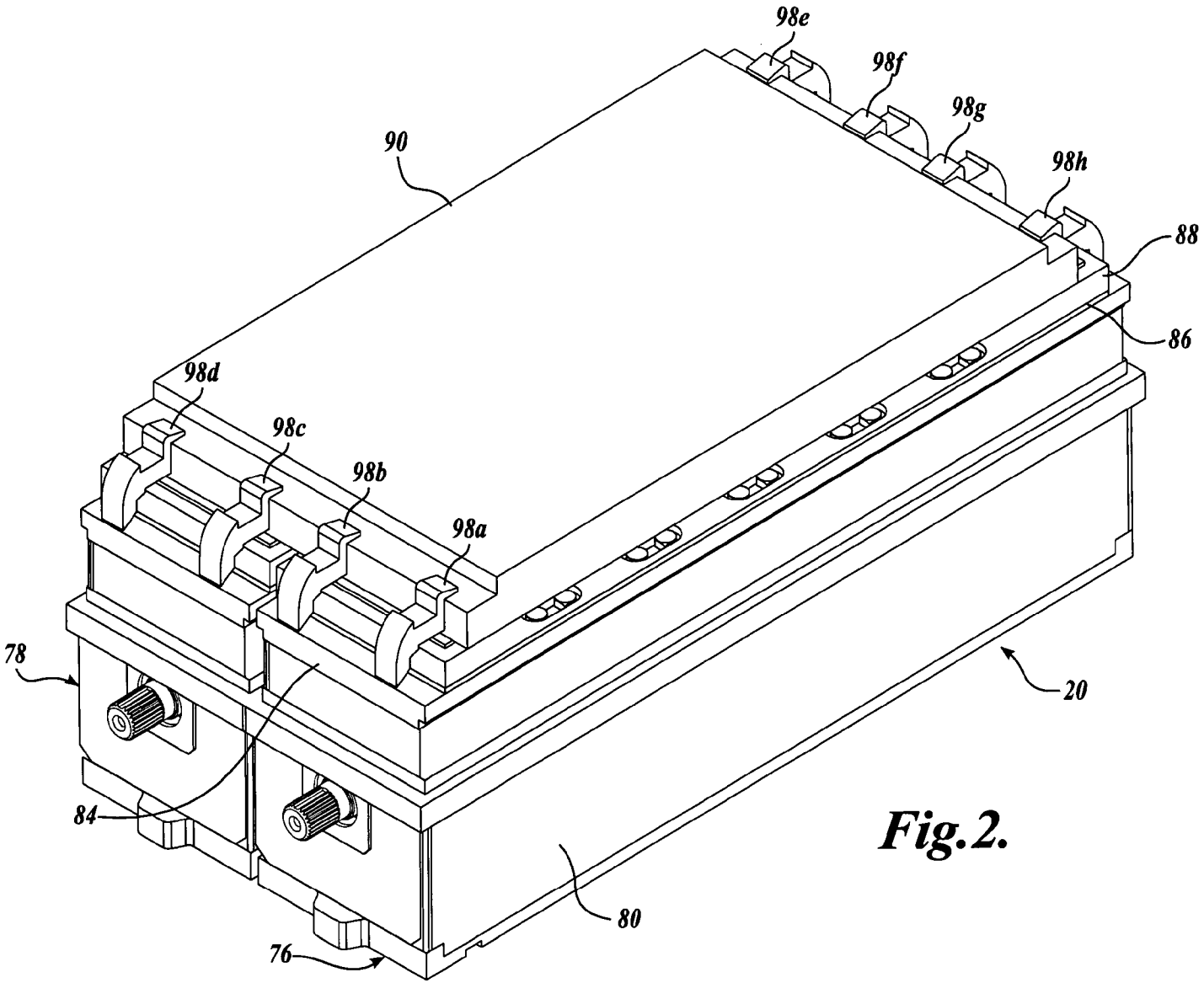
FIG. 2 is an isometric view of a press unit constructed in accordance with one embodiment of the present invention.

FIG. 1 illustrates a combination timing assembly and linking assembly 66 constructed in accordance with one embodiment of the present invention. The combination timing assembly and linking assembly 66 is shown as it would be used with a manufactured wood products press 60. Note that the manufactured wood products press 60 is suitably a well-known press used in producing manufactured wood products, such as OSB. One such press is described in a co-pending U.S. patent application Ser. No. 11/236,925, entitled MANUFACTURED WOOD PRODUCT PRESS, assigned to Weyerhaeuser Company of Federal Way, Wash., the disclosure of which is hereby expressly incorporated by reference.

The manufactured wood products press 60 includes a press unit 20, a frame 62, and drive motors 64. The manufactured wood products press 60 suitably includes two press units 20 disposed within the frame 62 in an opposed manner. In the illustrated embodiment, there are a plurality of press units 20 disposed within the manufactured wood products press 60, such that a plurality of opposed press units 20 are positioned along a length of the manufactured wood products press 60. The plurality of press units 20 are coupled to and driven at least in part by the plurality of combination timing assembly and linking assemblies 66, as described in greater detail below.

As positioned within the frame 62, each press unit 20 counteracts the other during operation of the manufactured wood products press 60 to produce a wide variety of manufactured wood products. The production of such manufactured wood products is well-known in the art and is not detailed for conciseness.

Individual press units 20 are actuated by rotating crank shafts 68 and 70 that are driven by the drive motors 64. The press units 20 are operated in a precisely coordinated manner, e.g., such that the drive shafts are rotationally in phase and are partially controlled by the gear box 66.

Although two press units 20 are illustrated, it should be apparent that the appended claims are not intended to be so limited. As a non-limiting example, the manufactured wood products press 60 may include only one press unit 20 positioned to be actuated against a fixed, opposing surface. Thus, manufactured wood products presses 60 having more or less press units 20 are also within the scope of the present disclosure.

The press unit 20 may be best understood by referring to FIGS. 2-7. The press unit 20 suitably includes first and second drive assemblies 76 and 78. Although the press unit 20 is illustrated as including two drive assemblies 76 and 78, it should be apparent that other press units having more or less drive assemblies are also within the scope of the present invention. As an example, a press unit with only one drive assembly or one having three or more drive assemblies is within the scope of the present invention. Also, because each drive assembly is identically configured, only one drive assembly will be described in greater detail. However, the description of one drive assembly is equally applicable to all drive assemblies of similar construction.

The drive assembly 76 includes a housing 80, a drive mechanism 82, a conversion plate 84, and an insulation layer 86. The drive assembly 76 also includes a key plate 88 and a platen 90. The housing 80 is suitably configured to house the drive mechanism 82 in a bath of lubricant, such as oil (not shown). Although the press unit 20 is illustrated as having two separate housing, other embodiments, such as a press unit having a single housing, are also within the scope of the present disclosure.

Figure 3:
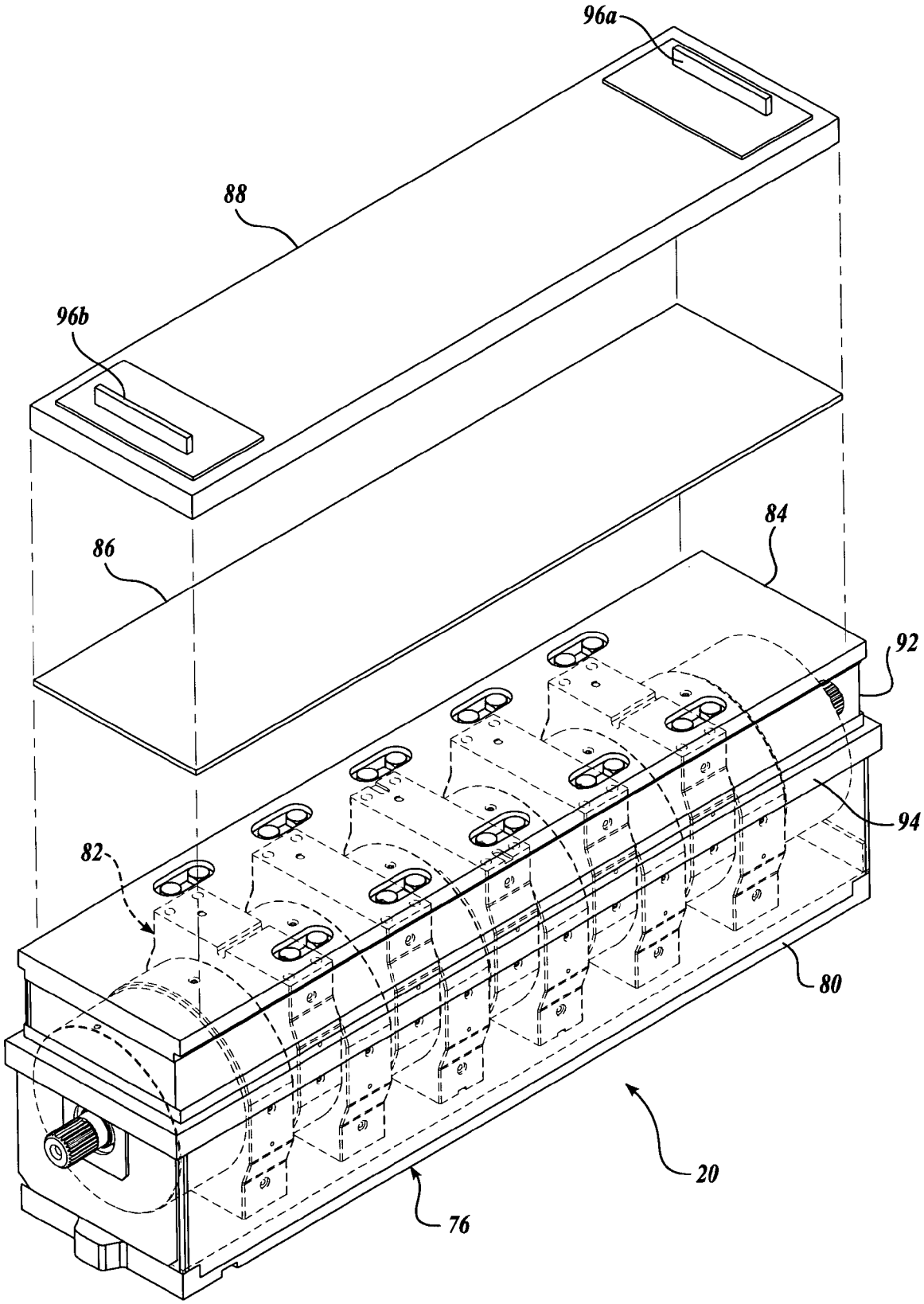
FIG. 3 is an isometric, partially exploded view of a drive assembly for the press unit of FIG. 2.

As may be best seen by referring to FIG. 3, the conversion plate 84 is suitably attached to a portion of the drive mechanism 82. A lower surface of the conversion plate 84 includes a downwardly extending oil shield 92. The oil shield 92 is sized to be sealingly engaged with an upper end 94 of the housing 20. During operation of the press unit, the oil shield 92 reciprocates or slides within the upper end 94 of the housing 80. As configured, the oil shield seals the bath of lubricants disposed within the housing 80 and permits the drive mechanism 82 to be driven by the drive motors 64 in a manner described in greater detail below.

Still referring to FIG. 3, the insulation layer 86 is sandwiched between an upper surface of the conversion plate 84 and a lower surface of the key plate 88. The sandwiched assembly is attached to the drive assembly 76 by well-known fasteners, such as bolts. The well-known platen 90 is fastened, at least in part, to the key plate 88 by a pair of attachment keys 96*a* and 96*b* lockingly engaging a corresponding notch (not shown) located in a lower surface of the platen 90. To further secure the platen 92 to the drive assembly 76, well-known anchors 98*a*-98*h* (FIG. 2) secure perimeter end portions of the platen 90 to the drive assembly 76, where it is driven by the drive mechanism 82.

Figure 4A:
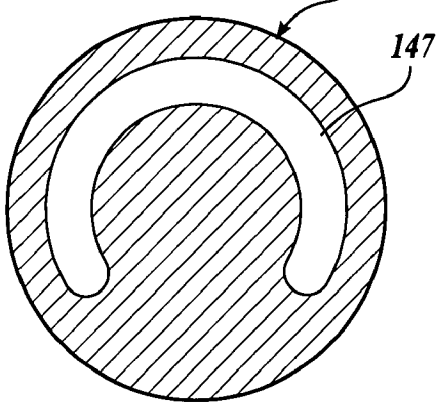
FIG. 4A is an end planar view of an end cap for the drive assembly taken substantially through Section 4A-4A of FIG. 4.
Figure 4:
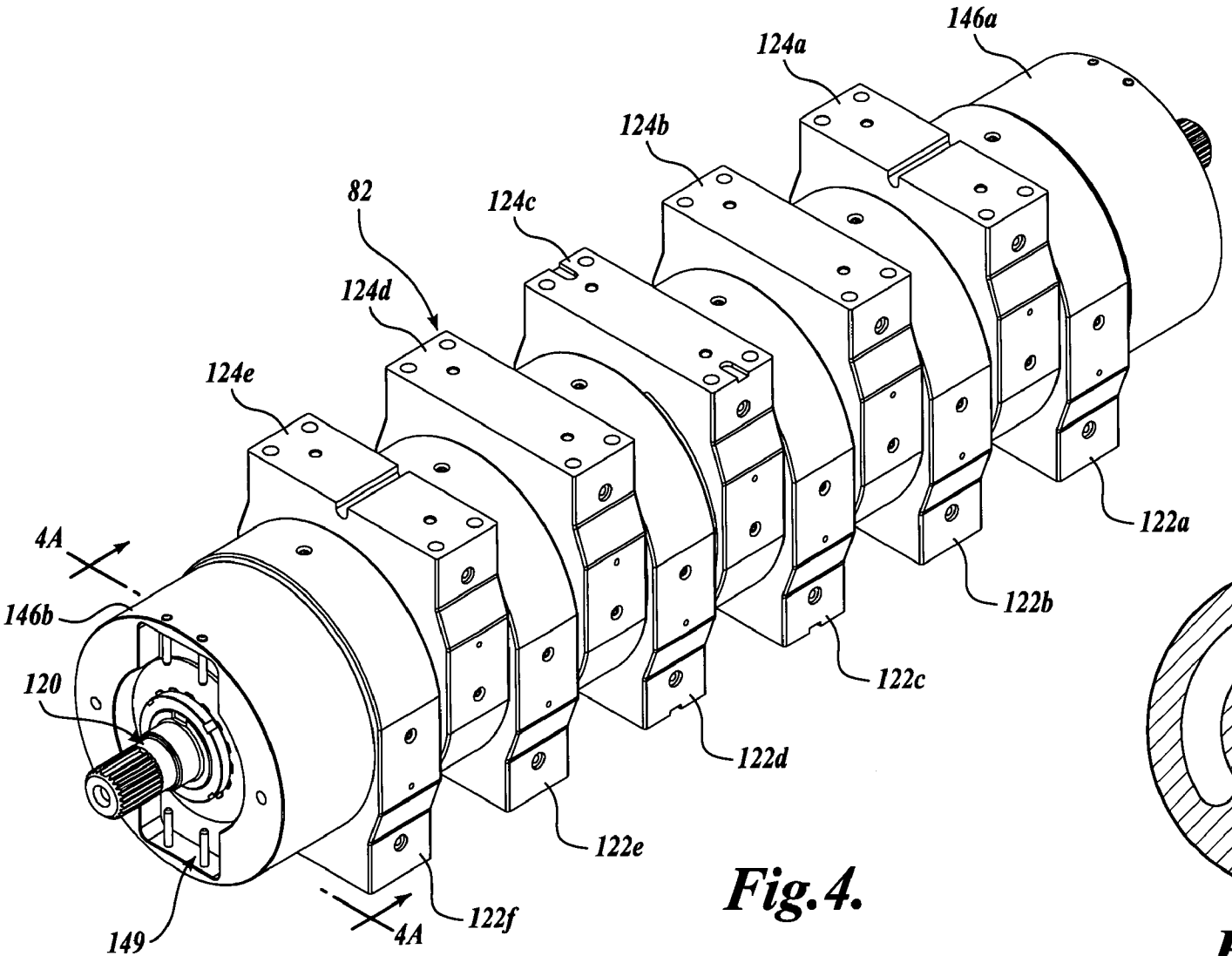
FIG. 4 is an isometric view of a drive mechanism constructed in accordance with one embodiment of the present invention and usable in the drive assembly of FIG. 3.
Figures 5, 5A:
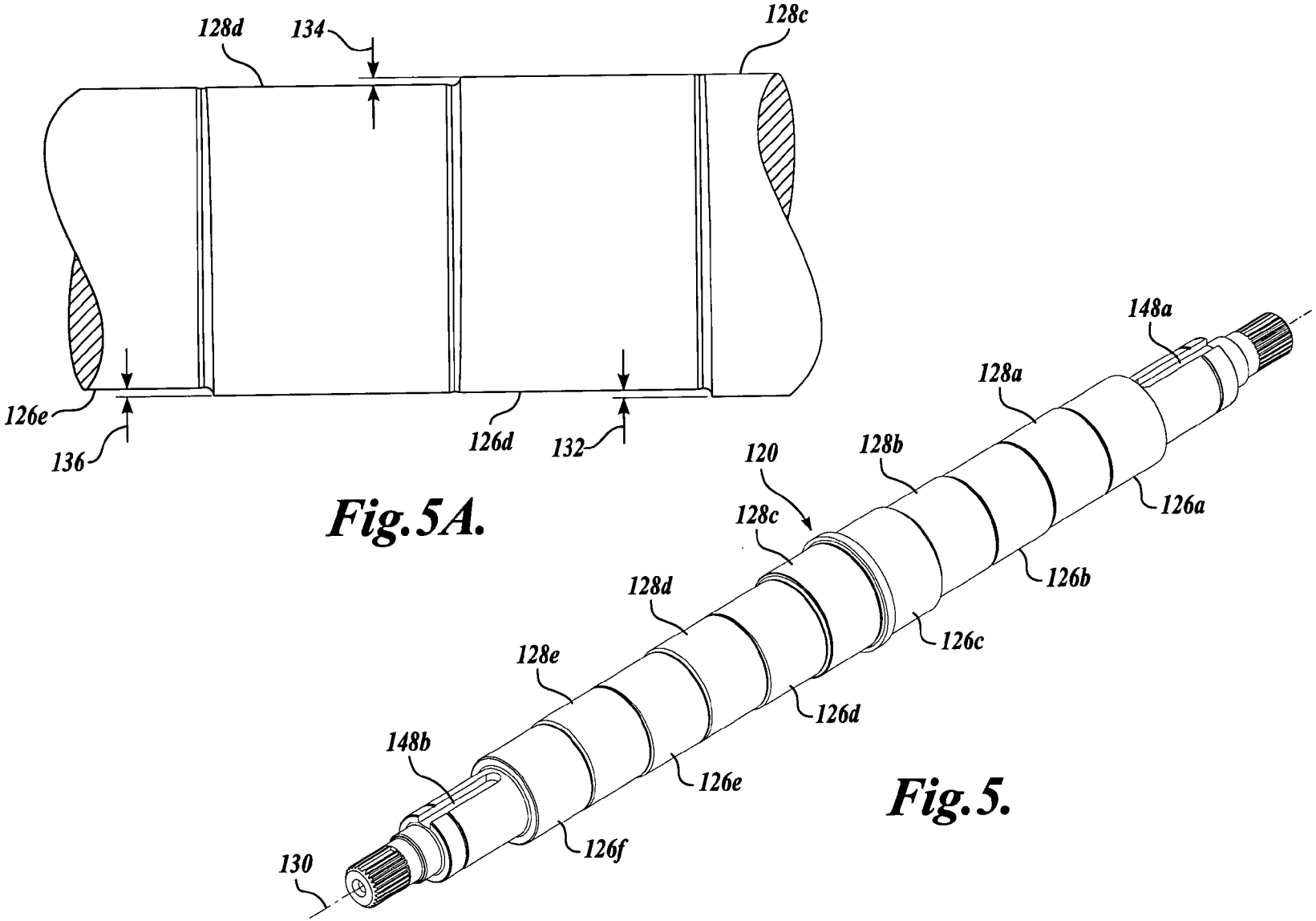
FIG. 5 is an isometric view of a shaft constructed in accordance with one embodiment of the present invention and usable with a drive mechanism of FIG. 4.
FIG. 5A is a side planar view amplifying a portion of the shaft of FIG. 5 and showing offsets between adjacent concentric and eccentric portions of the shaft.
Figure 6:
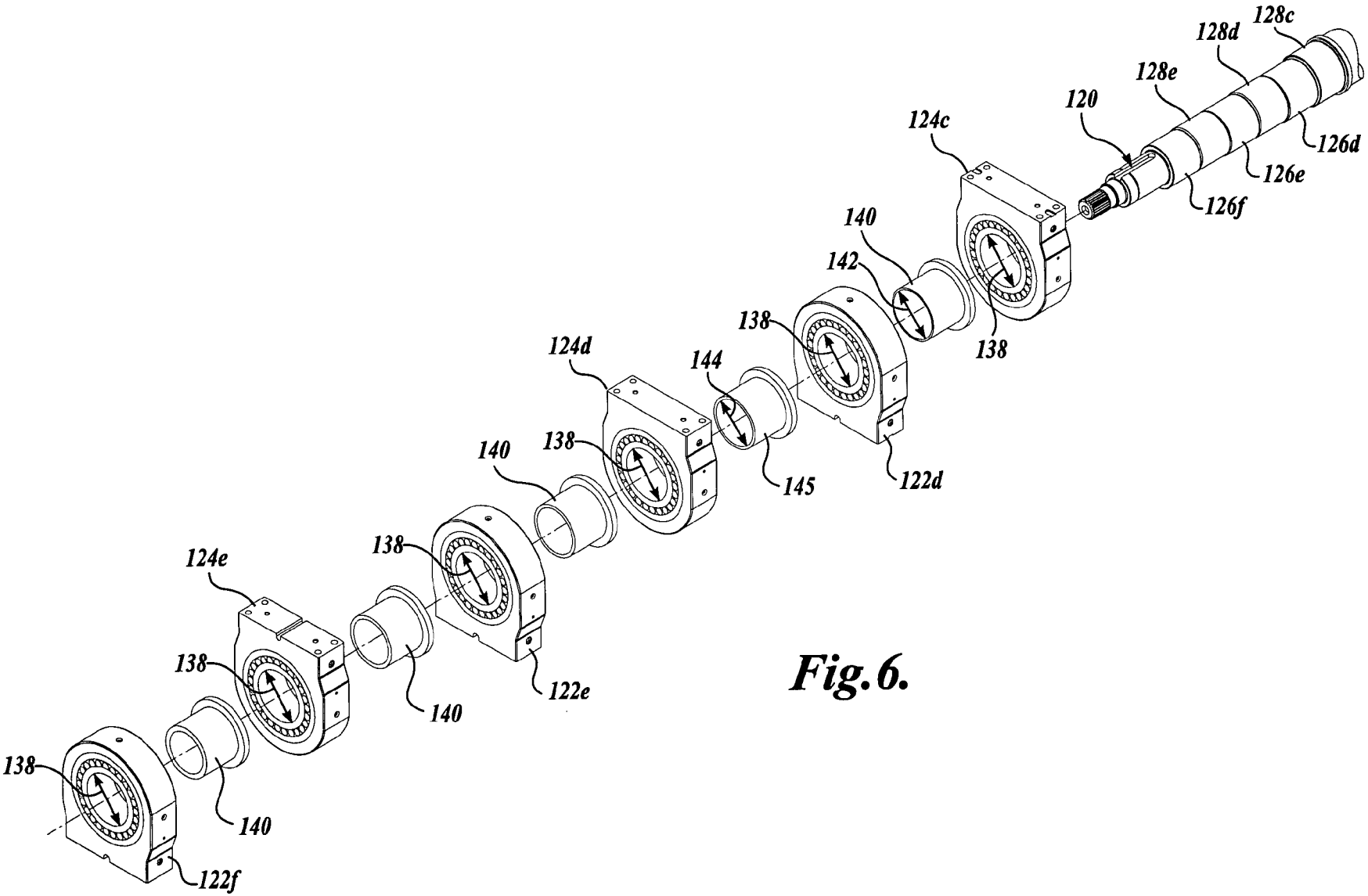
FIG. 6 is an isometric, partially exploded view of the drive mechanism of FIG. 4 showing various components of the drive mechanism.

The drive mechanism 82 may be best understood by referring to FIGS. 4-6. The drive mechanism 82 includes a shaft 120, a plurality of support bearing members 122*a*-122*f*, and a plurality of platen drive bearing members 124*a*-124*e*. Although a prescribed number of support bearing members 122*a*-122*f* and platen drive bearing members 124*a*-124*e* are illustrated, it should be apparent that a drive mechanism 82 having any number combination of support bearing members 122 and platen drive bearing members 124 is also within the scope of the present invention. Thus, a drive mechanism 82 having more or fewer support bearing members 122 and platen drive bearing members 124 is also within the scope of the present invention.

As may be best seen by referring to FIG. 5, the shaft 120 is suitably formed from any well-known, high strength material, such as steel, and includes a plurality of concentric portions 126*a*-126*f* and a plurality of eccentric portions 128*a*-128*e*. The concentric and eccentric portions are suitably integrally formed with the shaft 120 during manufacture of the shaft 120. The concentric and eccentric portions are disposed along a longitudinal axis 130 extending through the length of the shaft 120 and are disposed on the shaft 120 in an alternating fashion. As an example, the concentric and eccentric portions are disposed in an alternating fashion between the ends of the shaft 120, such that an eccentric portion is disposed between two concentric portions.

All of the concentric portions 126*a*-126*f* share a common axis of rotation during operation. Similarly, all eccentric portions 128*a*-128*e* share a second common axis of rotation, different from the axis of rotation of the concentric portions 126*a*-126*f*. This aspect is described in greater detail below with respect to FIGS. 7A-7C.

The axis of rotation of the eccentric portions 128*a*-128*e* is offset from the axis of rotation of the concentric portions 126*a*-126*f*. As best seen by referring to FIG. 5A, the eccentric portions 128*a*-128*e* have a circular cross-section and are offset from the circular cross-section of the concentric portions by an equal amount. Specifically, the eccentric portion 128*c* is positioned adjacent the concentric portion 126*d* and the axis of rotation of the eccentric portion 128*c* is off-set from the axis of rotation of the concentric portion 126*d* by an amount illustrated by the arrow 132.

Similarly, the eccentric portion 128*d* has an axis of rotation offset from the adjacent concentric portion 126*e* by an amount illustrated by the arrow 134. Finally, the axis of rotation of the eccentric portion 128*d* is offset from the axis of rotation of the adjacent concentric portion 126*f* by an amount illustrated by the arrow 136.

The alternating eccentric and concentric portions have an increasing diameter as viewed from the ends towards the middle of the shaft 120. This configuration accommodates support bearing members 122 and platen drive bearing members 124 of the same internal diameter to minimize cost and expense. It should be apparent that although a shaft 120 having such a configuration is preferred, other embodiments are also within the scope of the present invention.

As a non-limiting example, a shaft 120 having all eccentric portions of constant diameter and all concentric portions of a second diameter but different from the diameter of the eccentric portions is also within the scope of the present invention. In this non-limiting example, the use of well known split bearings sized to fit one of the eccentric or concentric portions may be utilized as support bearing members and platen drive bearing members. Thus, shafts 120 of different constructions are also within the scope of the present invention.

As may be best seen by referring to FIG. 6, the support bearing members 122 and platen drive bearing members 124 are mounted to the concentric portions 126 and eccentric portions 128, respectively, on bushings. In the partial view of FIG. 6, the support bearing members 122*d*-122*f* and the platen drive bearing members 124*c*-124*e* are well-known pillow blocks. Each one of the support bearing members 122 and platen drive bearing members 124 are identically configured and include an attachment opening of constant diameter represented by the arrow 138.

During assembly, support bearing members 122 are mounted on the concentric portion 126 and the corresponding land for each one of the bearing members 122 is positioned to be anchored to the housing 80. The housing 80 may, in turn, be anchored to a support footing (not shown) to absorb loads associated with operation of the press unit 20.

Each of the platen drive bearing members 124 are rotated 180° from the support bearing members 122 such that the land of each of the platen drive bearing members 124 is positioned to be coupled to the platen 90 in a manner described above. The support bearing members 122 and platen drive bearing members 124 are seated on corresponding eccentric or concentric portion on bushing 140. For ease of manufacture, the thickness of each cylindrical portion of each bushing 140 is dimensioned to accommodate the sizing requirements of the shaft 120.

Specifically, and as an example, the bushing 140 is sized to be received within the attachment opening of the platen drive bearing member 124*c*. The attachment opening has a diameter (indicated by the arrow 142) large enough to be slidably received on the shaft 120, such that it fits snugly on the outside diameter of the eccentric portion 128*c*. The attachment opening is large enough to pass freely over all of the other concentric and eccentric portions during its path of travel along the shaft 120.

Similarly, the bushing 145 is sized to be received within the support bearing member 122*d*. The bushing 145 has an opening 144 sized to be received on the outside diameter of the concentric portion 126*d* but is smaller than the outside diameter of eccentric portion 128*c*. However, the inside diameter of the opening 144 slides freely over all other eccentric and concentric portions of the shaft 120. As noted above, this design permits the use of identical support bearings members 122 and platen drive bearing members 124.

As assembled, each of the support bearing members 122*a*-122*f* and platen drive bearing members 124*a*-124*e* are secured to the shaft 120 by well-known end caps 146*a* and 146*b*. As seen in FIG. 4A, each end cap 146*a* and 146*b* is sized and configured to act as a counterbalance to the platen 90 during operation of the press unit 20. The end caps 146*a* and 146*b* are suitably formed from a solid piece of high strength material, such as aluminum. The interior is machined to create a substantially C-shaped channel 147 extending substantially the entire length of the end cap. By the inclusion of the channel 147 in the end caps, the end caps 146*a* and 146*b* act as a counterbalance to the platen 90 during operation. Specifically, the end caps 146*a* and 146*b* are mounted to respective ends of the shaft 120, such that the closed end of the channel 147 is located nearest the platen 90.

Referring back to FIG. 4, the ends of the end caps 146*a* and 146*b* also include an optional mass adjustment assembly 149. The mass adjustment assembly 149 is a pair of opposed prongs. The prongs are sized and configured to receive corresponding mass plates (not shown) to permit selective addition of mass to the end caps 146*a* and 146*b* to selectively adjust the counterbalancing characteristics of the end caps 146*a* and 146*b*.

Each of the end caps are keyed to the shaft 120 by a protrusion (not shown) formed within an internal cavity of the end cap. The protrusion of the end caps is sized to be received within a corresponding notch 148*a* and 148*b* formed in respective ends of the shaft 120. The assembled drive mechanism 82 is then disposed within the housing 80 and connected to the drive motors 64 in a manner well-known in the art.

Figures 7A, 7B, 7C:
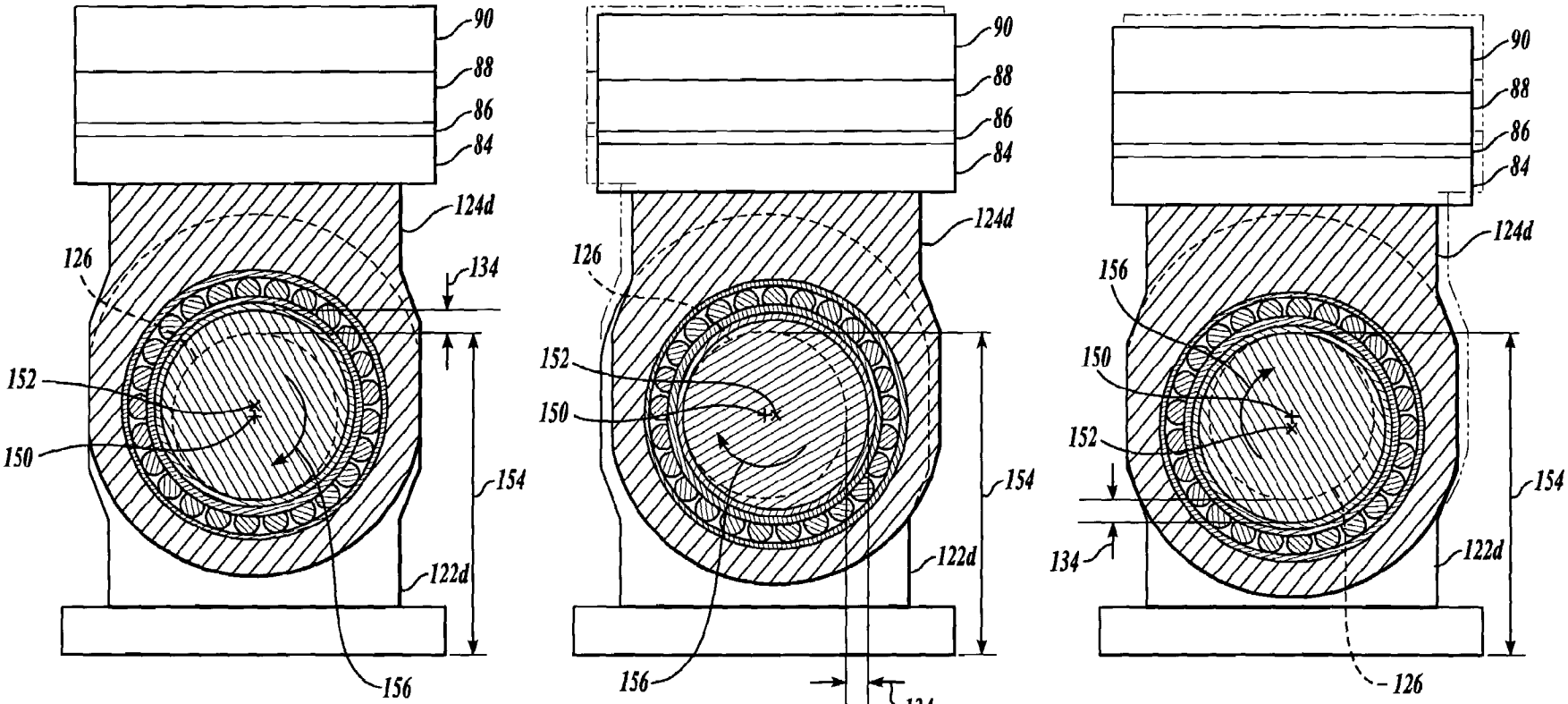
FIG. 7A is an end view of the press unit of FIG. 2, showing the press unit in an extended position during normal operations of the press unit.
FIG. 7B is an end planar view of the press unit of FIG. 7A and showing the press unit in a mid-lift position during operation of the press unit.
FIG. 7C is an end planar view of the press unit of FIG. 7A and showing the press unit in a fully retracted position during normal operating conditions of the press unit.

Operation of the press unit 20 may be best understood by referring to FIGS. 7A-7C. It should be apparent that FIGS. 7A-7C are sequential cross-sectional end planar views of a portion of the drive mechanism 82 during operation to illustrate sequential movements of the press unit 20. For ease of illustration and clarity in understanding movement of various components of the press unit 20, certain dimensions have been exaggerated and, therefore, illustrated spacing is not intended to be limiting.

As described above, the concentric portions 126*a*-126*f* rotate about a constant axis of rotation, referred to as a concentric axis of rotation 150. As also described above, the eccentric portions 128*a*-128*e* rotate about a second axis of rotation, known as an eccentric axis of rotation 152. However, as the drive motors 64 rotate the shaft 120, and due to the offset 134, the eccentric axis of rotation 152 rotates around the concentric axis of rotation 150.

As driven, the drive assembly 76 moves in a non-linear motion. To better illustrate this motion, and still referring to FIGS. 7A-7C, assume that the drive motors 64 turn the shafts 120 in a clockwise direction about the concentric axis of rotation 150 and as indicated by the arrow 156. As driven, the concentric portion 126 rotates about the concentric axis of rotation 150, such that it remains a fixed distance from the base of the housing 80 and indicated by the arrow 154 throughout the operation cycle of the press unit 20.

At the same time, however, due to the offset distance 134, the eccentric axis of rotation 152 of the eccentric portions 128 rotates about the concentric axis of rotation 150 to drive the platen 90 from a fully extended position (FIG. 7A) to a mid-position (FIG. 7B), and finally to a fully retracted or down position (FIG. 7C). As the drive motors 64 continue to drive the press unit 20, the platen 90 is returned to the fully extended position (FIG. 7A). Thus, the drive motors 64 drive the drive assembly 76 between a fully extended position, to a fully retracted position, and returns back to the fully extended position. This type of motion drives the platen 90 in a substantially non-linear motion, such as circular.

A press unit 20 constructed in accordance with the various embodiments of the present invention provides a compact and highly reliable alternative to existing press units.

Figure 8:
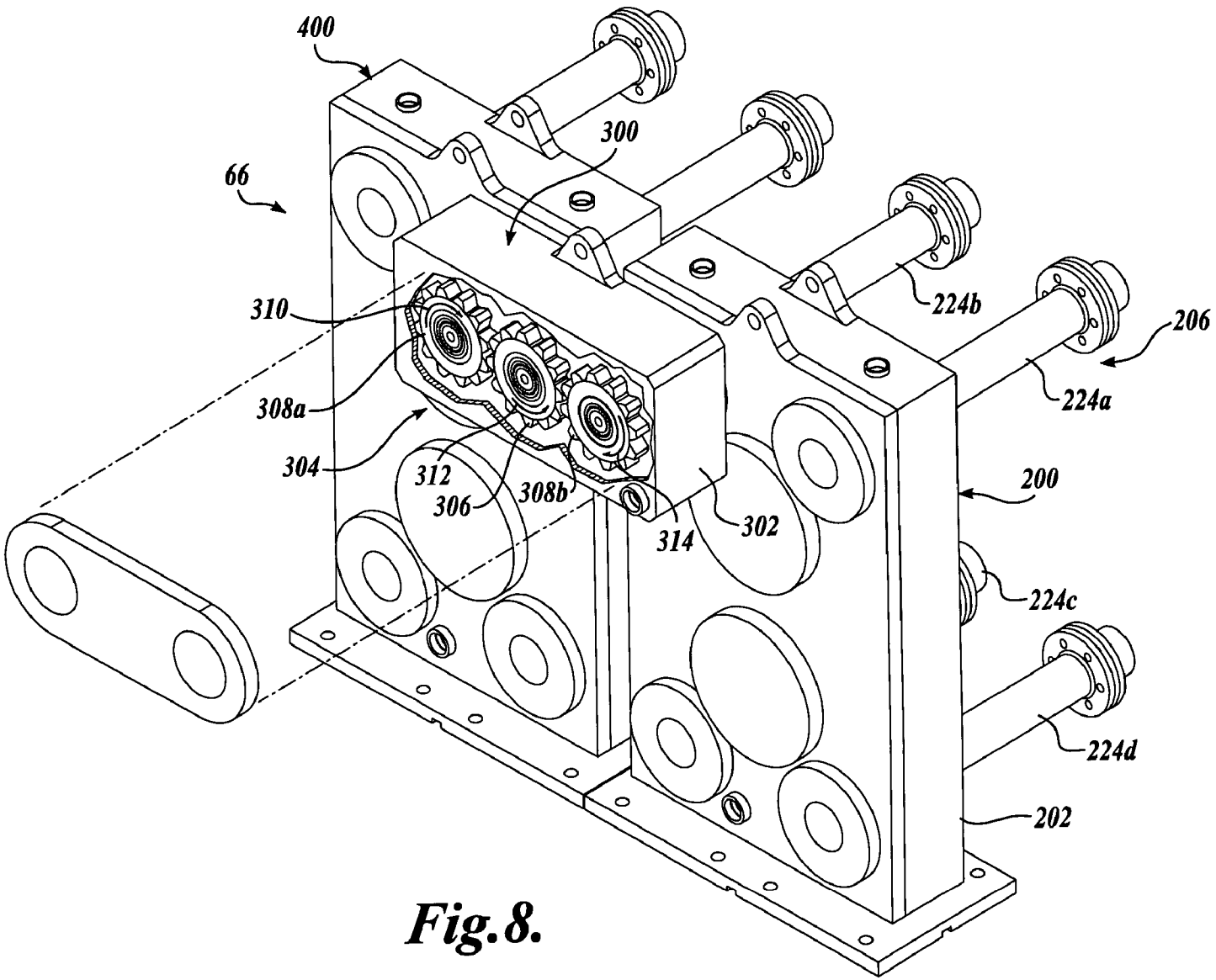
FIG. 8 is an isometric view of a timing assembly and linking assembly constructed in accordance with one embodiment of the present disclosure, showing a portion of the linking assembly cut away to show the linking gears.
Figure 9:
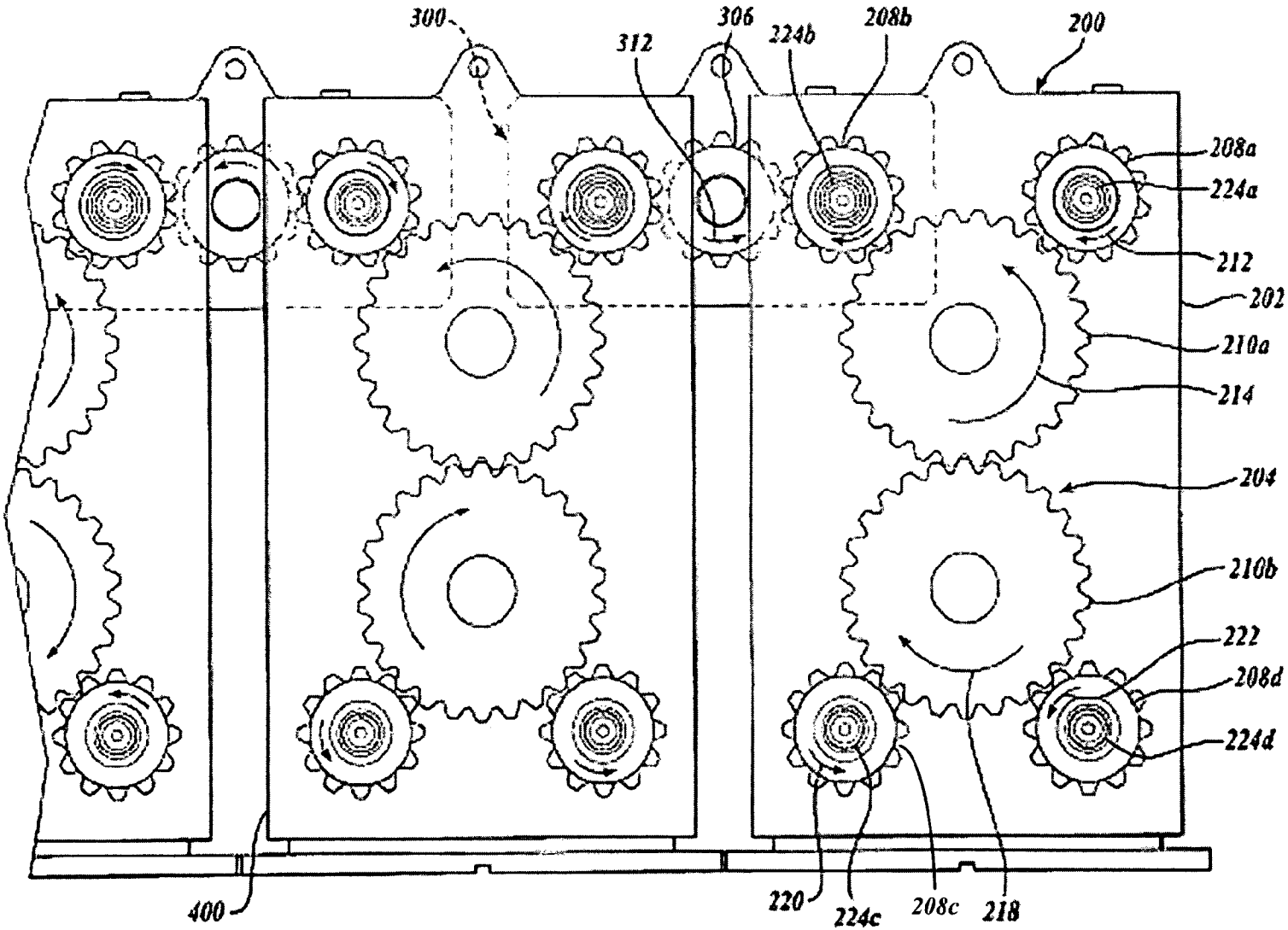
FIG. 9 is a side planar view of a timing assembly and linking assembly constructed in accordance with one embodiment of the present disclosure and showing a plurality of gears.

The combination timing assembly and linking assembly 66 may be best understood by referring to FIGS. 8 and 9. The combination timing assembly and linking assembly 66 includes a main gear assembly 200 and a linking gear assembly 300. Although the combination timing assembly and linking assembly 66 is illustrated as including both the main gear assembly 200 and linking gear assembly 300, it should be apparent that the main gear assembly 200 and linking gear assembly 300 may be used with the manufactured wood products press 60 alone and not necessarily in combination. Thus, a manufactured wood products press having a main gear assembly 200, a linking gear assembly 300, or a combination of both are all within the scope of the present disclosure.

The main gear assembly 200 includes a housing 202, a plurality of timing gears 204, and a plurality of drive mechanisms 206. The plurality of timing gears 204 are rotatably disposed within the housing 202 and include a plurality of carrier gears 208*a*-208*d*. The plurality of timing gears 204 also includes first and second drive gears 210*a* and 210*b*. The plurality of carrier gears 208*a*-208*d* and first and second drive gears 210*a* and 210*b* are located within the housing 202 such that the first and second drive gears 210*a* and 210*b* are positioned between the plurality of carrier gears 208*a*-208*d* for synchronized movement.

Specifically, and as may be best seen by referring to FIG. 9, the carrier gears 208*a* and 208*d* are positioned in the corners of the housing 202, with the first and second drive gears 210*a* and 210*b* located near the center of the housing 202. In this embodiment, the first and second carrier gears 208*a* and 208*b* engage the first drive gear 210*a*. The first and second drive gears 210*a* and 210*b* are engaged, while the third and fourth carrier gears 208*c* and 208*d* engage the second drive gear 210*b*. As configured, rotation of one of the gears causes a corresponding rotation of the other gears.

As an example, if the first carrier gear 208*a* is driven in clockwise direction 212, because of its engagement with the first drive gear 210*a*, the first drive gear 210*a* is rotated in a counterclockwise direction 214. Because of its engagement with both the second carrier gear 208*b* and the second drive gear 210*b*, rotation of the first drive gear 210*a* causes the second carrier gear 208*b* to rotate in a clockwise direction 216 and, simultaneously causes the second drive gear 210*b* in a clockwise direction 218. As rotated, and because the third and fourth carrier gears 208*c* and 208 engage the second drive gear 210*b*, the third and fourth carrier gears 208*c* and 208*d* are rotated in counterclockwise directions 220 and 222, respectively.

It is this simultaneous and synchronized movement of the plurality of timing gears 204 that cause the opposed platens 90 of the press units 20 to operate in unity, as described in greater detail below.

The plurality of drive mechanisms 206 may be best understood by referring to both FIGS. 8 and 9. The plurality of drive mechanisms 206 includes a plurality of drive shafts 224*a*-224*b*. In this embodiment, one end of the drive shafts 224*a*-224*b* are operatively coupled, in a manner well-known in the art, to carrier gears 208*a*-208*d*. The other end of the drive shafts 224*a*-224*d* are similarly coupled to the drive shafts 120 of the press units 20 to simultaneously drive the drive shafts 120 in the eccentric path described above with respect to FIGS. 7A-7C.

If the manufactured wood products press 66 includes more than one pair of press units 20, it is desirable to include multiple timing assemblies 200. Coordinated and synchronized motion of the press units 20 is accomplished at least in part by synchronizing the timing assemblies 200 to each other by the linking gear assembly 300.

The linking gear assembly 300 may be best understood by referring to FIG. 8. The linking gear assembly 300 includes a housing 302 and a plurality of linking gears 304. The plurality of linking gears 304 includes a linking drive gear 306 and first and second linking carrier gears 308*a* and 308*b*. Preferably, the linking drive gear 306 is disposed between the first and second linking carrier gears 308*a* and 308*b*, such that rotation of one of the plurality of linking gears 304 causes rotation of the other linking gears.

As an example, rotation of the first linking carrier gear 308*a* in a clockwise direction 310 causes the linking drive gear 306 to rotate in a counterclockwise direction 312. Because the second linking carrier gear 308*b* is meshed to the linking drive gear 306, rotation of the linking drive gear 306 in the counterclockwise direction 312 causes the second linking carrier gear 308*b* to rotate in a clockwise direction 314.

Figure 10:
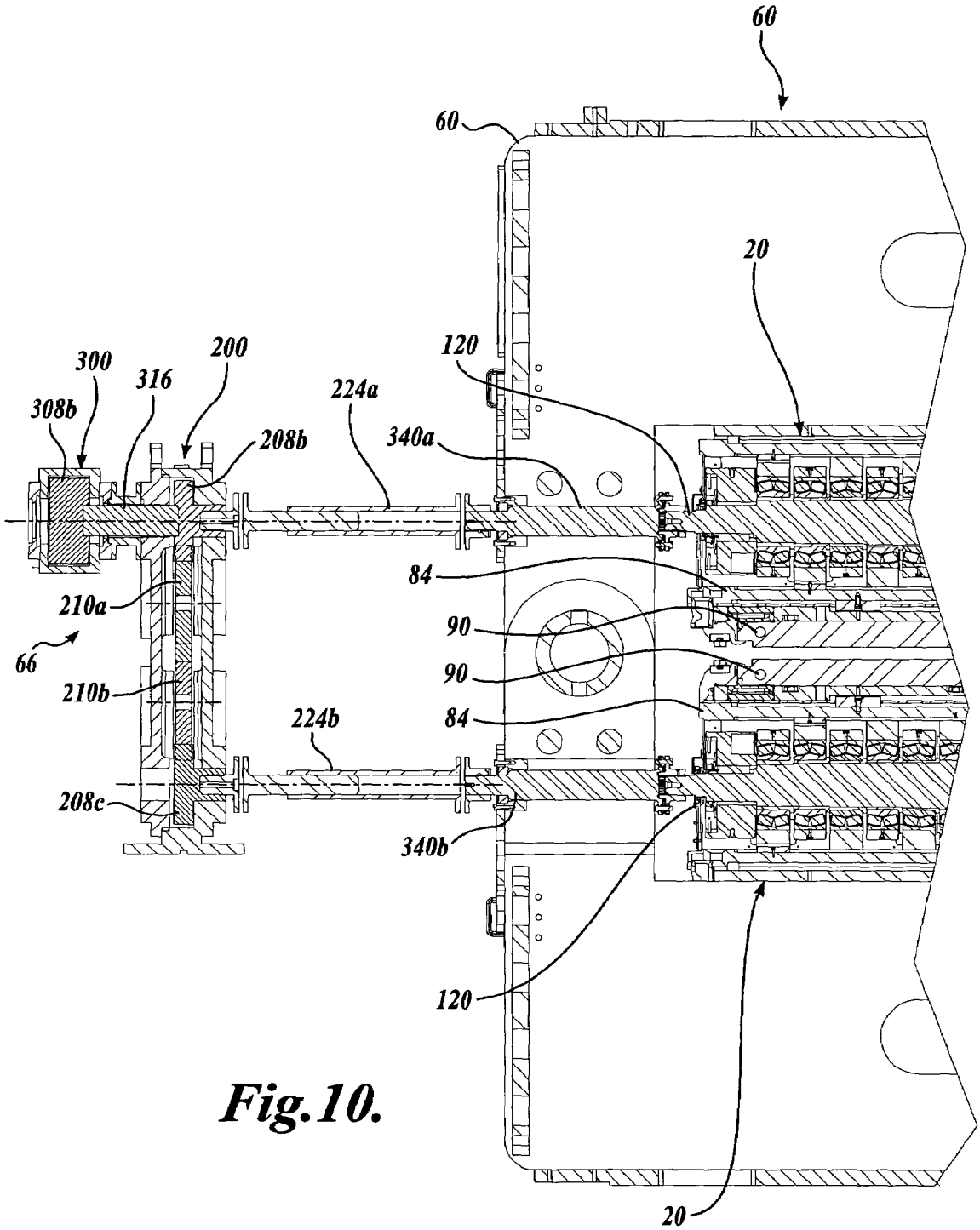
FIG. 10 is a partial, cross-sectional view of timing assembly and linking assembly, showing operational connection of the timing assembly, linking assembly, and the press units.

As may be best seen by referring to FIG. 10, the linking gear assembly 300 includes a linking drive shaft 316. The linking drive shaft 316 extends between one of the plurality of linking gears 304 and one of the plurality of timing gears 204. As an example, the linking drive shaft 316 extends between and couples the second carrier gear 208*b* and the second linking carrier gear 308*b*. As configured, the linking drive shaft 316 synchronizes rotation of the second linking carrier gear 308*b* with the second carrier gear 208*b*.

It should be apparent that although the linking drive shaft 316 is illustrated and described as linking the second carrier gear 208*b* and the second linking carrier gear 308*b*, the scope of this disclosure is not intended to be so limited. As an example and as best seen by referring to FIGS. 1 and 8-10, the manufactured wood products press 60 includes a plurality of press units 20. In order to simultaneously link operation of all of the plurality of press units 20, the manufactured wood products press 60 includes a plurality of timing assemblies 200 and linking assemblies 300. Each one of the timing assemblies 200 and linking assemblies 300 are identically configured as described above.

Where a plurality of timing assemblies 200 are use to coordinate and operate a plurality of press units 20, the plurality of timing assemblies 200 are coupled to each other by the linking assemblies 300. As illustrated in the example of FIGS. 8-10, rotation of the second lining carrier gear 308*b* is tied to the rotation of the second carrier gear 208*b* by the linking drive shaft 316. Although not illustrated in FIG. 10 due to illustration limitations, the first linking carrier gear 308*a* is similarly coupled to a first carrier gear (not shown) of a second main gear assembly 400 by another linking drive shaft (not shown). Because the first and second linking carrier gears 308*a* and 308*b* are synchronized by the linking drive gear 306, both the rate of rotation and direction of rotation of the first and second linking carrier gears 308*a* and 308*b* are the same.

Thus, it should be apparent that as many or as few timing and linking assemblies 200 and 300 may be coupled to the manufactured wood products press 60 as necessary to link operation of all of the press units 20.

Operation of the timing and linking assemblies 200 and 300 may be best understood by referring to FIGS. 8-10. As noted above, a manufactured wood products press 60 having a plurality of press units 20 requires that all of the press units 20 operate simultaneously. Specifically, such a press 60 requires that all of the shafts 120 of each press unit 20 be synchronized, such that all shafts 120 begin in the same position and rotate at the same velocity. As a result, the timing of the motion of the platens 90 must be synchronized, such that motion of all the platens 90 is coordinated to provide the desired movement, such as compression. This synchronization is accomplished by the timing and linking assemblies 200 and 300.

As seen best in FIG. 10, the combination timing assembly and linking assembly 66 is coupled to the shaft 120 of each press unit 20. In this view, there are two press units 20 disposed in an opposed relationship within the frame 62. As previously described, each press unit 20 includes a shaft 120 adapted to drive a platen 90 in a substantially non-linear or circular motion. The drive shafts 224*a* and 224*b* of the combination timing assembly and linking assembly 66 are coupled to the shafts 120 of the press units 20 by a coupling drive shaft 340*a* and 340*b*. Although the use of a coupling drive shaft 340 is preferred, other embodiments, such as directly coupling the shaft 120 to the drive shaft 224, are also within the scope of the present disclosure.

As coupled to the combination timing assembly and linking assembly 66 and because the plurality of timing gears 204 and the plurality of linking gears 304 are meshed, operation of the press units 20 are all simultaneous and synchronized with each other. Such an assembly provides an inexpensive solution to timing operation of a manufactured wood products press 66 having at least two opposed platens.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A timing assembly for a manufactured wood products press having a first drive shaft coupled to a first platen and second drive shaft coupled to a second platen, the first and second platens disposed within the manufactured wood products press in an vertically opposed manner, the timing assembly comprising:

(a) a housing having four corners and a center; and (b) a plurality of timing gears disposed within the housing and operatively connected to the first and second drive shafts, the plurality of timing gears comprising:

a first carrier gear positioned near a first corner of the housing;

a second carrier gear positioned near a second corner of the housing;

a first drive gear positioned near the center of the housing; and a second drive gear positioned near the center of the housing, the first and second drive gears being disposed between the first and second carrier gears to transmit motion between the first and second carrier gears, thereby simultaneously driving the first platen and second platen in a substantially non-linear path.

2. The timing assembly of claim 1, further comprising a first drive mechanism operatively connecting the first carrier gear to the first drive shaft to transmit rotary motion to the first drive shaft to drive the first platen in a non-linear path.

3. The timing assembly of claim 2, further comprising a second drive mechanism operatively connecting the second carrier gear to the second drive shaft to transmit rotary motion to the second drive shaft to drive the second platen in a non-linear path.

4. The timing assembly of claim 1, wherein the plurality of timing gears further comprising third and fourth carrier gears.

5. The timing assembly of claim 4, wherein the first and second drive gears are disposed between all of the carrier gears.

6. The timing assembly of claim 5, further comprising a plurality of drive mechanisms coupled to the carrier gears to transmit rotary motion.

7. The timing assembly of claim 1, further comprising a linking gear box assembly coupled to one of either the first or second carrier gears.

8. The timing assembly of claim 7, wherein the linking gear box assembly includes a drive member adapted to transmit rotary motion.

9. The timing assembly of claim 1, further comprising a linking gear box assembly coupled to one of the plurality of timing gears.

10. The timing assembly of claim 9, further comprising a linking drive shaft extending between one of the plurality of linking gears and one of the plurality of timing gears.

11. The timing assembly of claim 10, further comprising a second linking drive shaft extending between one of the plurality of linking gears and a second timing assembly.

12. A combination timing assembly and linking assembly for a manufactured wood products press having a first drive shaft coupled to a first platen and second drive shaft coupled to a second platen, the first and second platens disposed within the manufactured wood products press in vertically opposed manner, the combination timing assembly and linking assembly comprising:

(a) a main gear assembly, comprising:

(i) a first housing;

(ii) a plurality of timing gears disposed within the first housing; and (iii) a first drive mechanism extending between the plurality of timing gears and one of either the first or second drive shafts to transmit motion between the main gear assembly and the first or second platen to drive the first or second platen in a non-linear motion; and (b) a linking gear assembly, comprising:

(i) a second housing;

(ii) a plurality of linking gears disposed within the second housing; and (iii) a linking drive shaft extending between one of the plurality of timing gears and one of the plurality of linking gears wherein the first drive shaft is arranged in a first plane that is substantially parallel to the first platen and the second drive shaft is arranged in a second plane that is substantially parallel to the second platen.

13. The combination timing assembly and linking assembly of claim 12, further comprising a second drive mechanism extending between the plurality of timing gears and the other of either the first or second drive shafts, such that the first and second drive mechanisms simultaneously drive the first and second platens in vertically opposed manner.

14. The combination timing assembly and linking assembly of claim 13, further comprising a second main gear assembly coupled to and driven at least in part by the linking gear assembly.

15. The combination timing assembly and linking assembly of claim 14, wherein the second main gear assembly includes a second drive mechanism extending between the second main gear assembly and a drive shaft of a third platen.

16. The combination timing assembly and linking assembly of claim 15, wherein the linking gear assembly is coupled to the second main gear assembly to simultaneously drive the first, second, and third platens.

17. A combination timing assembly and linking assembly for a manufactured wood products press having a first pair of vertically opposed platens and a second pair of vertically opposed platens, the first pair of vertically opposed platens having a first plurality of drive shafts and the second pair of vertically opposed platens having a second plurality of drive shafts, the combination timing assembly and linking assembly comprising:

(a) a first main gear assembly having a plurality of gears operatively connected to the first plurality of drive shafts;

(b) a second main gear assembly having a plurality of gears operatively connected to the second plurality of drive shafts;

(c) a linking gear assembly, the linking pear assembly comprising a housing and a plurality of linking gears, the plurality of linking gears comprising:

a first linking carrier gear;

a second linking carrier gear; and a linking drive gear disposed between the first linking carrier gear and the second linking carrier gear; and (d) a plurality of timing gears operatively connected to the first main gear assembly and the second main gear assembly;

wherein the linking gear assembly is coupled to the first and second main gear assemblies to simultaneously drive, at least in part, the first and second pairs of vertically opposed platens in a non-linear motion.

18. The combination timing and linking assembly of claim 17, wherein the linking gear assembly synchronously drives the first and second pairs of vertically opposed platens in the non-linear motion.

19. The combination timing and linking assembly of claim 17, wherein the plurality of timing gears comprises:

a first timing carrier gear;

a second timing carrier gear;

a first timing drive gear; and a second timing drive gear, the first and second timing drive gears being disposed between the first and second timing carrier gears.

20. The combination and linking assembly of claim 18 wherein the non-linear motion is circular motion.

* * * * *

UNITED STATES PATENT AND TRADEMARK OFFICE

CERTIFICATE OF CORRECTION

PATENT NO. : 7,640,854 B2
APPLICATION NO. : 11/237560
DATED : January 5, 2010
INVENTOR(S) : Norbert Kott et al.

It is certified that error appears in the above-identified patent and that said Letters Patent is hereby corrected as shown below:

Col. 10, Lines 31 through 32, should read as follows:

... within the manufactured wood products press in a vertically opposed manner ...

Col. 10, Lines 60 through 61, should read as follows:

... simultaneously drive the first and second platens in a vertically opposed manner ...

Signed and Sealed this

Twenty-third Day of February, 2010

David J. Kappos

David J. Kappos
*Director of the United States Patent and Trademark Office*